US009418523B1

(12) United States Patent
Wu et al.

(10) Patent No.: US 9,418,523 B1
(45) Date of Patent: Aug. 16, 2016

(54) INTELLIGENT WIRELESS DOORBELL ALARM SYSTEM

(71) Applicant: UNITY OPTO TECHNOLOGY CO., LTD., New Taipei (TW)

(72) Inventors: Chih-Hsien Wu, New Taipei (TW); Wei Chang, New Taipei (TW); Kai-Cheng Chuang, New Taipei (TW); Yi-Shu Chen, New Taipei (TW)

(73) Assignee: Unity Opto Technology Co., Ltd., New Taipei (TW)

( * ) Notice: Subject to any disclaimer, the term of this patent is extended or adjusted under 35 U.S.C. 154(b) by 0 days.

(21) Appl. No.: 14/700,447

(22) Filed: Apr. 30, 2015

(30) Foreign Application Priority Data

Mar. 20, 2015 (TW) ..... 104204195 U

(51) Int. Cl.
*G08B 5/36* (2006.01)

(52) U.S. Cl.
CPC ..... *G08B 5/36* (2013.01)

(58) Field of Classification Search
CPC ..... G08B 5/36; G08B 3/1016
USPC ..... 340/286.04, 328, 326, 332
See application file for complete search history.

(56) References Cited

U.S. PATENT DOCUMENTS 5,045,833 A * 9/1991 Smith ..... G08B 5/36 340/332
6,992,591 B2 * 1/2006 Jensen ..... F21S 9/02 340/326
2015/0116109 A1 * 4/2015 Fadell ..... G08B 19/005 340/501

* cited by examiner

*Primary Examiner* — Kevin Kim
(74) *Attorney, Agent, or Firm* — Rosenberg, Klein & Lee

(57) ABSTRACT

An intelligent wireless doorbell alarm system driven and set by a wireless communication protocol includes at least one doorbell switch, plural lamps and an electronic device. The doorbell switch has a wireless signal module for generating a startup signal after the being triggered. The lamps are electrically coupled to one another. Each lamp has a wireless transmission module and a driving module and is electrically coupled to the doorbell switch for receiving the startup signal. The electronic device is electrically coupled to the lamps and has a setup module for setting the lamps.

11 Claims, 6 Drawing Sheets

INTELLIGENT WIRELESS DOORBELL ALARM SYSTEM

CROSS-REFERENCE TO RELATED APPLICATIONS

This non-provisional application claims priority under 35 §119(a) on Patent Application No(s). 104204195 filed in Taiwan, R.O.C. on Mar. 20, 2015, the entire contents of which are hereby incorporated by reference.

BACKGROUND OF THE INVENTION

1. Field of the Invention

The present invention relates to a home alarm system, and more particularly to an intelligent wireless doorbell alarm system that drives and sets up a lamp to achieve an excellent alarm effect.

2. Description of the Related Art

Doorbell is a common necessary household device with the functions of telling a house owner about the arrival of a guest or a visitor or providing the guest or visitor a polite way of informing his/her arrival. In a conventional doorbell device, a switch is installed outside a door, and at least one buzzer is installed at an indoor place such as a dining room or a room and electrically connected to the switch through an electric wire, so that when the switch is triggered by the guest or visitor, a driving signal is transmitted to the buzzer through the electric wire to remind the house owner.

To avoid disturbing neighbors, the buzzer of the conventional doorbell device is set to a low volume, but the house owner may ignore the doorbell or do not hear the ring at all when the house owner is busy or situated at a position farther, from the buzzer, or there are many floors in the house, and thus the doorbell loses its function.

Therefore, additional buzzers are installed at different places of the house to improve the effectiveness of notification, but the number of connected wires and the required connected circuits will be increased significantly since the buzzers and the switch are connected by physical electric wires for transmitting the driving signal. Obviously, the conventional doorbell device with complicated circuits and wires is inconvenient for maintenance and repair. Furthermore, once the switch is triggered, all drivers are driven to produce a very loud sound which affects others and fails to achieve the original intention of reducing the volume of sound. In addition, reminding the house owner by simply using the buzzer for alarm is monotonous and provides a relatively lower alarm effect, and the buzzers do not come with any other function until the doorbell is triggered.

Therefore, the inventor of the present invention invented an intelligent wireless doorbell alarm system in hope of overcoming the common drawbacks of the conventional doorbell.

SUMMARY OF THE INVENTION

Therefore, it is a primary objective of the present invention to provide an intelligent wireless doorbell alarm system that uses a lamp as an alarm device, and a wireless communication is provided for setup, connection, and driving, not just providing a diversified ways of notification only, but also achieving the alarm effect for an indoor space of a large area or a multiple of floors, and preventing the signal transmission accuracy or hit rate from being reduced by the wireless communication distance.

To achieve the aforementioned objective, the intelligent wireless doorbell alarm system of the present invention set and driven by a wireless communication protocol comprises: at least one doorbell switch, having a wireless signal module, for generating a startup signal after the doorbell switch is triggered; a plurality of lamps, each having a wireless transmission module and a driving module, and electrically coupled to one another through each respective wireless transmission module and also electrically coupled to the doorbell switch, and each driving module driving the lamps to give an alarm by light; and an electronic device, electrically coupled to the lamps, and having a setup module for setting the lamps, and operation information being generated and stored after each lamp is set; wherein, after the lamps receive the startup signal through the wireless transmission modules, the lamps are driven according to the operation information and/or the startup signal is transmitted to the other remaining lamps by the wireless transmission modules; and when each lamp receives the startup signal transmitted from other lamps is received again or the startup signal transmitted from the lamps has not been received within a predetermined time, the lamps stop the transmission of the startup signal. Preferably, the predetermined time falls within a range of 2-5 seconds, and the wireless communication protocol is Bluetooth, WiFi or Zigbee.

To improve the alarm effect of the present invention, the present invention further comprises a plurality of buzzers electrically coupled to the doorbell switch and the electronic device for accepting the setup and giving a sound alarm after the startup signal is received. Preferably, the buzzers are installed in the lamps and driven by the driving module, so that the lamps also have the effect of the sound alarm.

Wherein, each piece of operation information includes setup data of an alarm ON/OFF status, a light display status, a timing function of each lamp, or a combination thereof, and/or a sound reminding status of each buzzer, so that the lamps may execute the corresponding operation by the driving modules according to the operation information. Preferably, each driving module has a storage unit for storing the operation information.

To allow users to recognize each lamp to improve the speed and accuracy of the setup quickly, each lamp includes a recognition module having a code corresponsive to each respective lamp for confirming the code of each lamp when the wireless setup module is connected. Preferably, the recognition modules are quick response codes respectively.

In addition, the electronic device is a Smartphone or a tablet PC, and the setup module is an application program. To facilitate users to set up the lamps quickly and conveniently and improve the alarm performance, the electronic device synchronously receives the startup signal to display a doorbell ON message when the doorbell switch is triggered.

In summation of the description above, the present invention can improve the alarm performance of the doorbell effectively. Particularly, an excellent alarm effect for indoor space of a building with a large area or a multiple of floors is achieved. The invention not only provides the wireless operation and system that require no complicated wiring of the lamps, but also offering a mechanism for transmitting the startup signal to the lamps. Regardless of the communication protocol, the alarm effect is not affected significantly by the transmission distance, so that the lamps provide an effective alarm effect, and the lamps may be used for illumination while not being used for the alarm, so as to improve the practicality of the present invention.

DETAILED DESCRIPTION OF THE PREFERRED EMBODIMENTS

Figure 1:
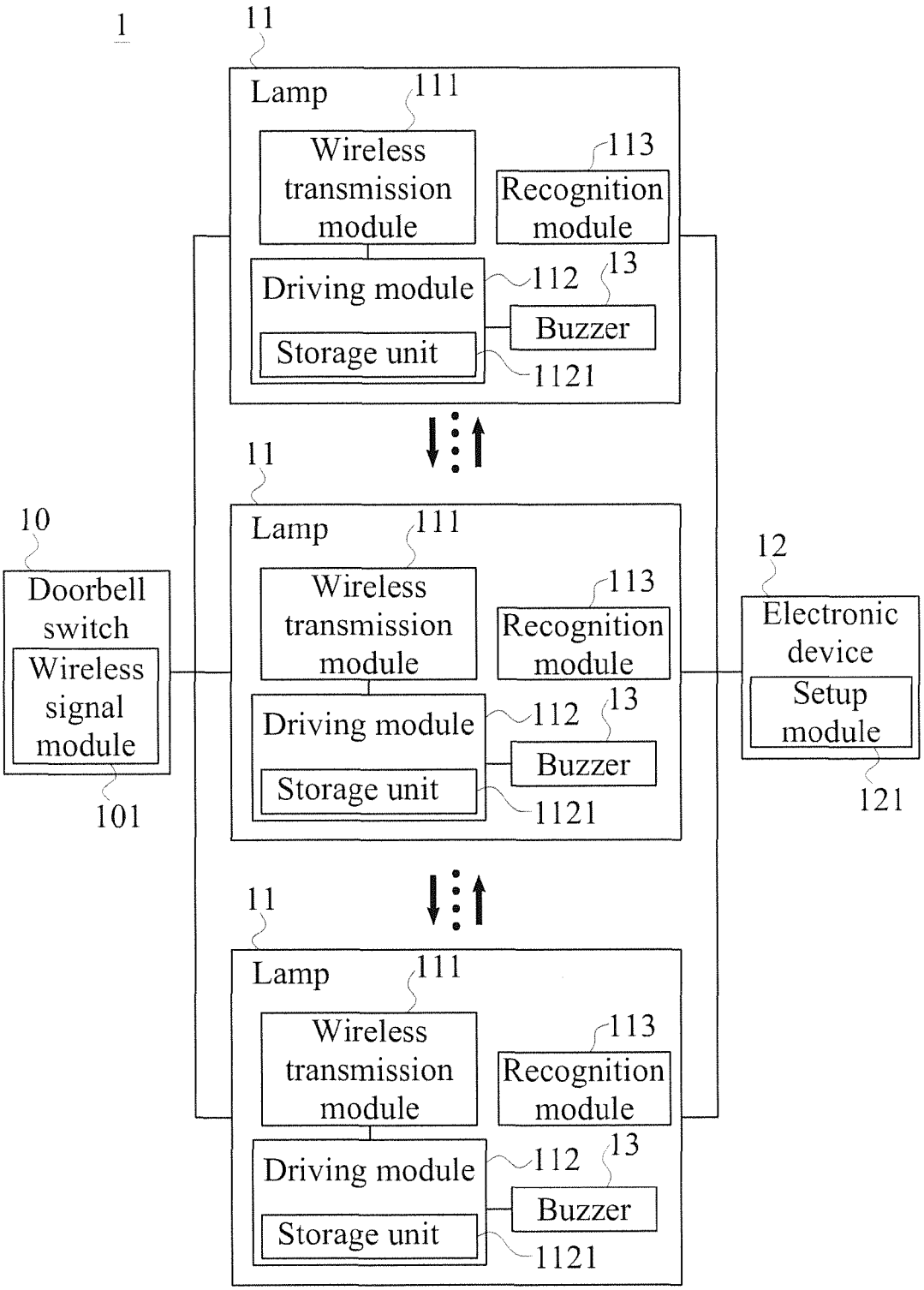
FIG. 1 is an exploded view of a schematic block diagram of a preferred embodiment of the present invention.
Figure 2:
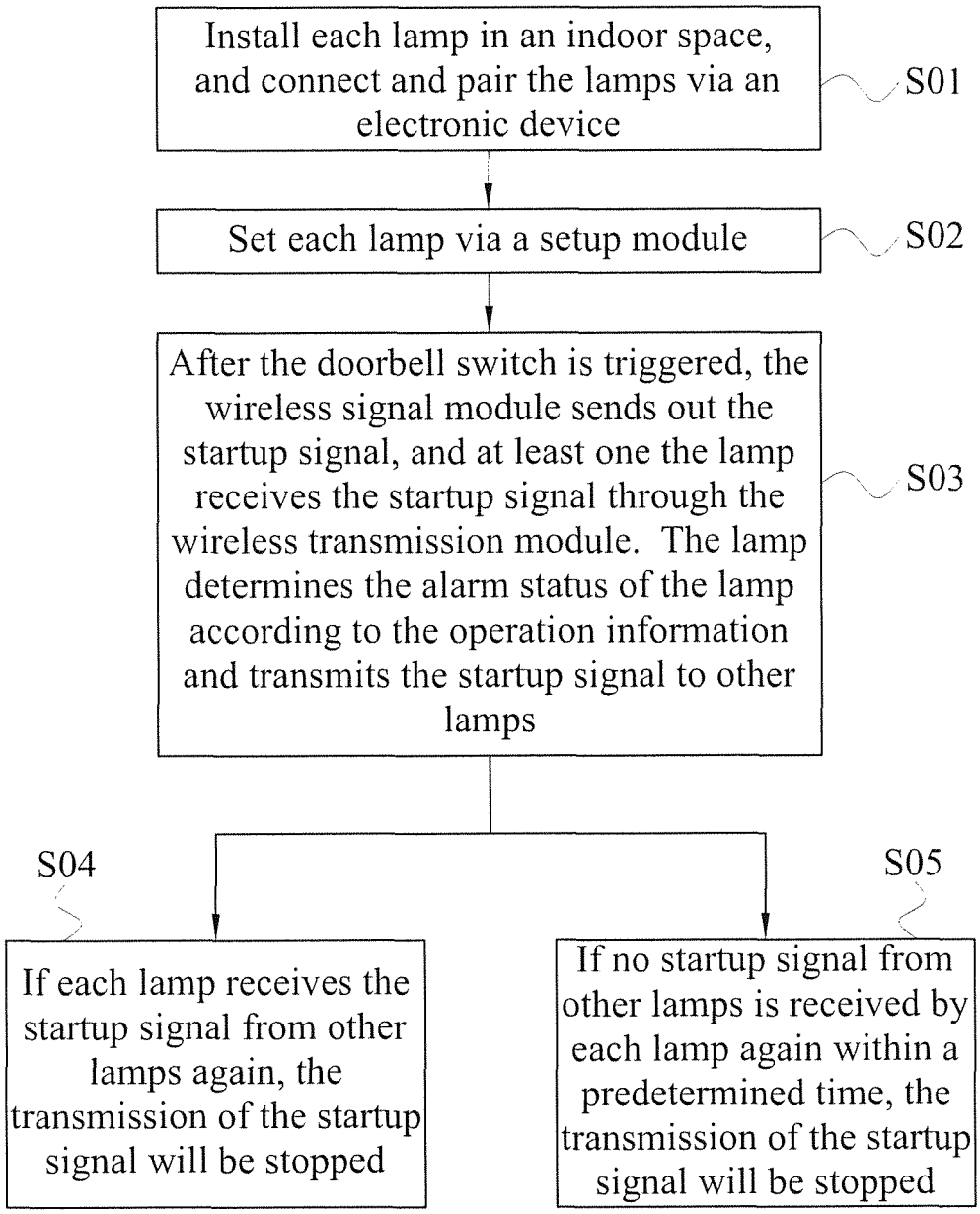
FIG. 2 is a flow chart of a preferred embodiment of the present invention.

The technical content of the present invention will become apparent with the detailed description of preferred embodiments and the illustration of related drawings as follows.

With reference to FIGS. 1, 2, 3 and 4-6 for a schematic block diagram, a flow chart, a schematic view of setting an application for a lamp, and schematic views of different applications of an intelligent wireless doorbell alarm system in accordance with a preferred embodiment of the present invention respectively, the intelligent wireless doorbell alarm system 1 may be applied to a building with a large area of a plurality of floors, wherein a wireless communication protocol is used for setting and driving the system, and the intelligent wireless doorbell alarm system comprises at least one doorbell switch 10, a plurality of lamps 11 and an electronic device 12.

The doorbell switch 10 is installed at an outdoor position proximate to an entrance or exit and provided for a visitor to trigger, and the doorbell switch 10 includes a wireless signal module 101 for generating a startup signal after the doorbell switch 10 is triggered and transmitting the startup signal via wireless transmission. Preferably, the lamp 11 is a spherical lamp, a down lamp, a ceiling lamp or a panel light and has a wireless transmission module 111 and a driving module 112 electrically coupled to one another through each wireless transmission module 111, and electrically coupled to the doorbell switch 10, and each driving module 112 is provided for driving the lamps 11 to give alarm by light, and each driving module 112 has a storage unit 1121. The electronic device 12 is electrically coupled to the lamps 11 and has a setup module 121 for setting the lamps 11. After each lamp 11 is set, operation information is generated and stored in the storage unit 1121. Preferably, the operation information includes an alarm ON/OFF status, a light display status, a timing function of each lamp 11, or a combination of the above, or setup data. In other words, the setup module 121 is provided for enable or disable the alarm of each lamp 11 and the light for the alarm of each lamp 11 may be set according to a user's preference of the color temperature that shows the light display status such as a blinking status or a continuously lit status, and the alarm operation time such as the alarm being issued after a specific time period. In the present invention, the wireless communication protocol is Bluetooth, WiFi or Zigbee, and the electronic device 12 is a portable device such as a Smartphone or a tablet PC, and the setup module 121 is an application program provided for facilitating the user's operation.

After the lamps 11 receive the startup signal through the wireless transmission modules 111, the lamps 11 are driven to give an alarm according to the operation information and/or the startup signal is sent to the other lamps 11 through the wireless transmission modules 111, so as to overcome the drawback of the wireless communication being limited by the transmission distance. In the present invention, each lamp 11 has the signal transmitting and receiving functions, so that even if some of the lamps 11 are too far from the doorbell switch 10, the closer lamps of the doorbell switch 10 may serve as relays to broadcast and transmit the startup signal to assure that the wireless transmission path of the startup signal is not limited by the distance significantly. If each lamp 11 receives the startup signal transmitted from other lamps 11 again, or no startup signal transmitted from lamps 11 is received within a predetermined time, the lamps 11 will stop the transmission of the startup signal. Preferably, the predetermined time falls within a range of 2-5 seconds. With the aforementioned two conditions for the wireless signal broadcast, each lamp 11 can receive the startup signal at the beginning of triggering the doorbell switch 10 and generating the startup signal and prevent the lamps 11 to continue transmitting the startup signal when the lamps 11 receives the startup signal repeatedly, or the lamps 11 broadcast the startup signal and have not received any response and automatically transmit the transmission of the startup signal. To enhance the warning performance, after the doorbell switch 10 is triggered, the electronic device 12 synchronously receives the startup signal and displays a doorbell ON message. The electronic device 12 automatically receives the startup signal of the doorbell switch 10 or the startup signal from other lamps 11 according to the position of the electronic device 12. Since the setup module 121 is an application program, the setup module 121 may be used for displaying and recording the doorbell ON message and compiling the doorbell ON message as a doorbell startup record and storing the record in the electronic device 12.

To provide a variety of alarms of the intelligent wireless doorbell alarm system 1, the present invention further comprises a plurality of buzzers 13 electrically coupled to the doorbell switch 10 and the electronic device 12 and driven by the startup signal to give alarm and receive setup information of the setup module 121. Preferably, the buzzers 13 are installed in the lamps 11 and driven by the driving module 112. Similarly, a user may use the electronic device 12 to set the buzzers 13 with regard to the type, the length, or the volume of the sound through the setup module 121, and such set information may be combined into the operation information, so that the operation information further includes a sound warning status to be stored in the storage unit 1121.

In addition, each lamp 11 includes a recognition module 113 having a code corresponsive to each lamp 11 for confirming each lamp 11 when the setup module 121 is connected. When a user uses the electronic device 12 to connect the lamps 11 via wireless transmission, the user may recognize each lamp 11 quickly to facilitate the setup of the aforementioned different alarm statuses of the at least one the lamp 11. Preferably, the recognition modules 113 are quick response codes.

The following procedure is described to make it easier to understand the operation of the present invention. For example, the intelligent wireless doorbell alarm system of the present is applied to an indoor space 2 of a multi-floor building as shown in FIGS. 2-6, and the procedure includes the following steps.

S01: Install each lamp 11 in the indoor space 2, and connect and pair the lamps 11 via the electronic device 12.

Figure 3:
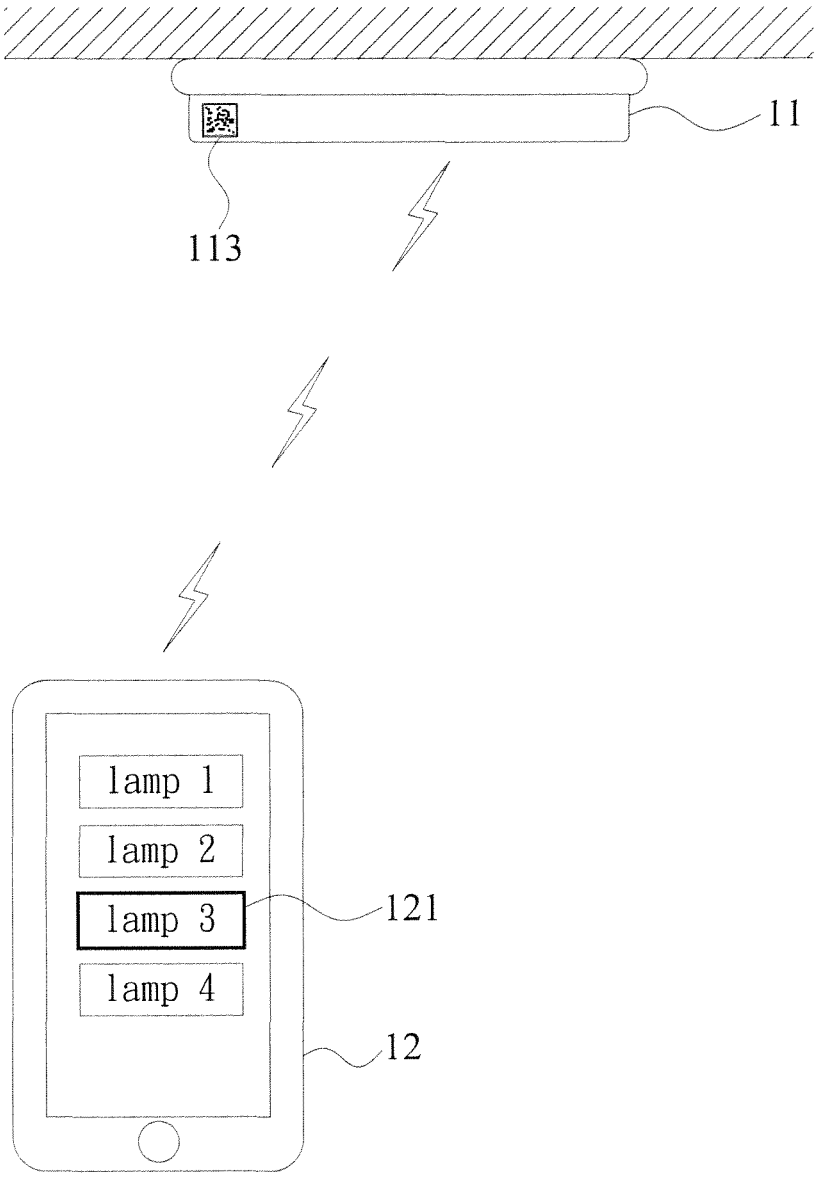
FIG. 3 is a schematic view of setting an application of a preferred embodiment of the present invention to a lamp.

The lamps 11 may be installed at different locations of the building such as a dining room, a bedroom, a study or a kitchen according to user requirements. In this preferred embodiment, the present invention is applied to a 3-floor building and an occupant of the building is situated at the third floor, and the building has three lamps 11 installed at the first floor, two lamps 11 at the second floor, and three lamps 11 at the third floor as shown in FIG. 3, and the user pairs the electronic device 12 with the lamps 11 by a wireless communication. Now, each lamp 11 displays a different code at the electronic device 12 according to the recognition modules 113. In this preferred embodiment, the electronic device 12 is a Smartphone, and the setup module 121 is an application program. However, FIG. 3 just shows a preferred embodiment only, but it is noteworthy that such embodiment is not intended for limiting the scope of the present invention.

S02: The setup module 121 sets each lamp 11.

As described above, the user may set the ON/OFF status, the light display status, and the timing function of each lamp 11 through the setup module 121. In this preferred embodiment, the lamps 11 include the buzzers 13, so that the setup module 121 may be used for setting the buzzers 13.

S03: After the setup is completed and the doorbell switch 10 is triggered, the wireless signal module 101 sends out the startup signal, and at least one the lamp 11 receives the startup signal through the wireless transmission module 111. The lamp 11 determines the alarm status of the lamp 11 according to the operation information and transmits the startup signal to other lamps 11.

Figure 4:
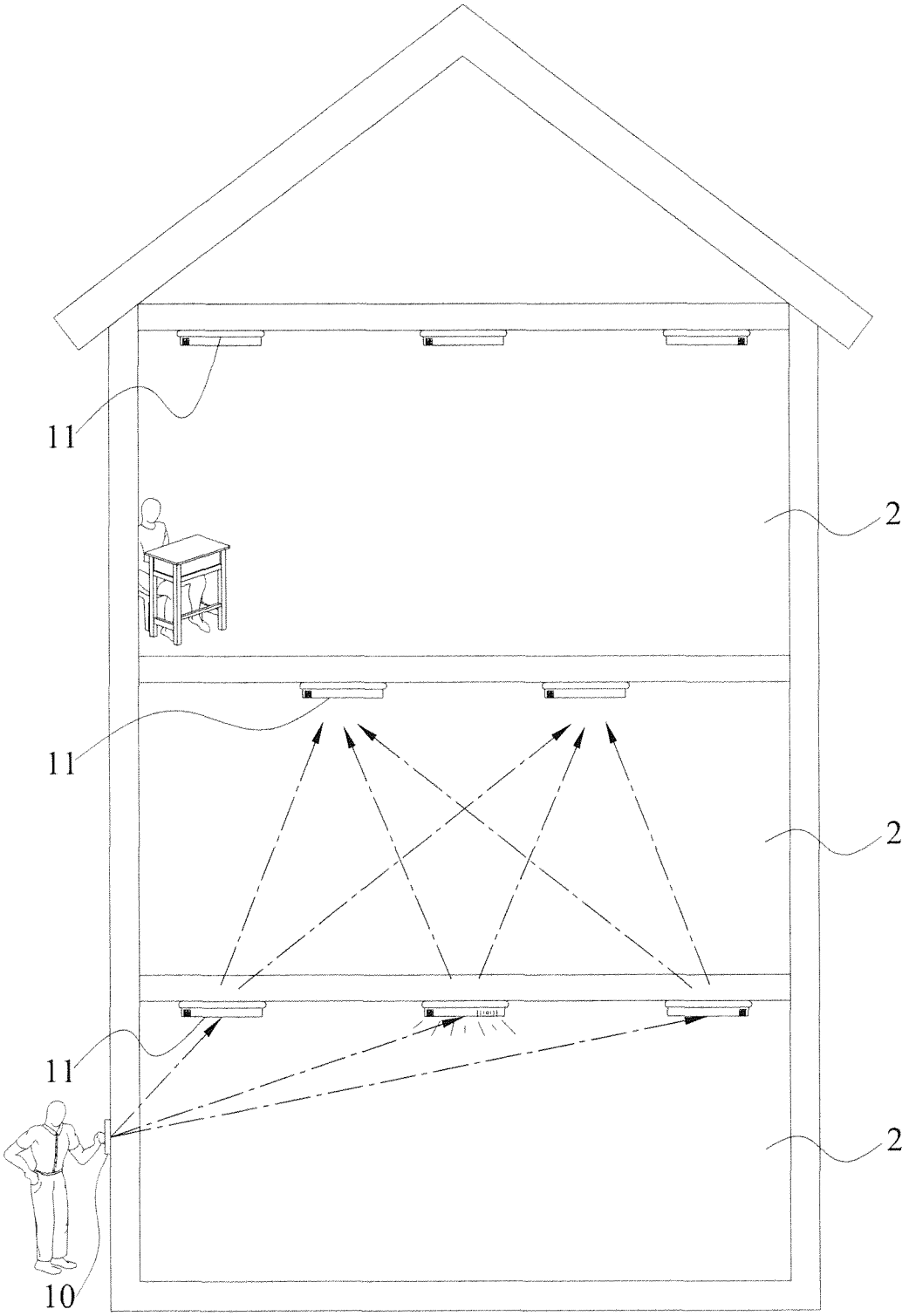
FIG. 4 is a schematic view of a first application of a preferred embodiment of the present invention.

With reference to FIG. 4 for a preferred embodiment of the present invention, after the doorbell switch 10 is triggered and the startup signal is generated, the startup signal is received by three closest lamps 11 at the first floor. Assumed that one of the lamps 11 is set to an ON status, a user is alarmed by light and/or sound about the light display status and the sound warning status according to the operation information. In the meantime, the other two lamps 11 continue transmitting the startup signal to the other lamps 11, so that the lamps 11 situated farther from the doorbell switch 10 can receive the startup signal quickly and effectively.

Step S04: After each lamp 11 has received the startup signal, the startup signal will be sent out again via the wireless communication protocol, so that when each lamp 11 receives the startup signal from other lamps 11, the transmission of the startup signal will be stopped.

Step S05: If no startup signal from other lamps 11 is received by each lamp 11 again within the predetermined time, the transmission of the startup signal will be stopped.

Figure 5:
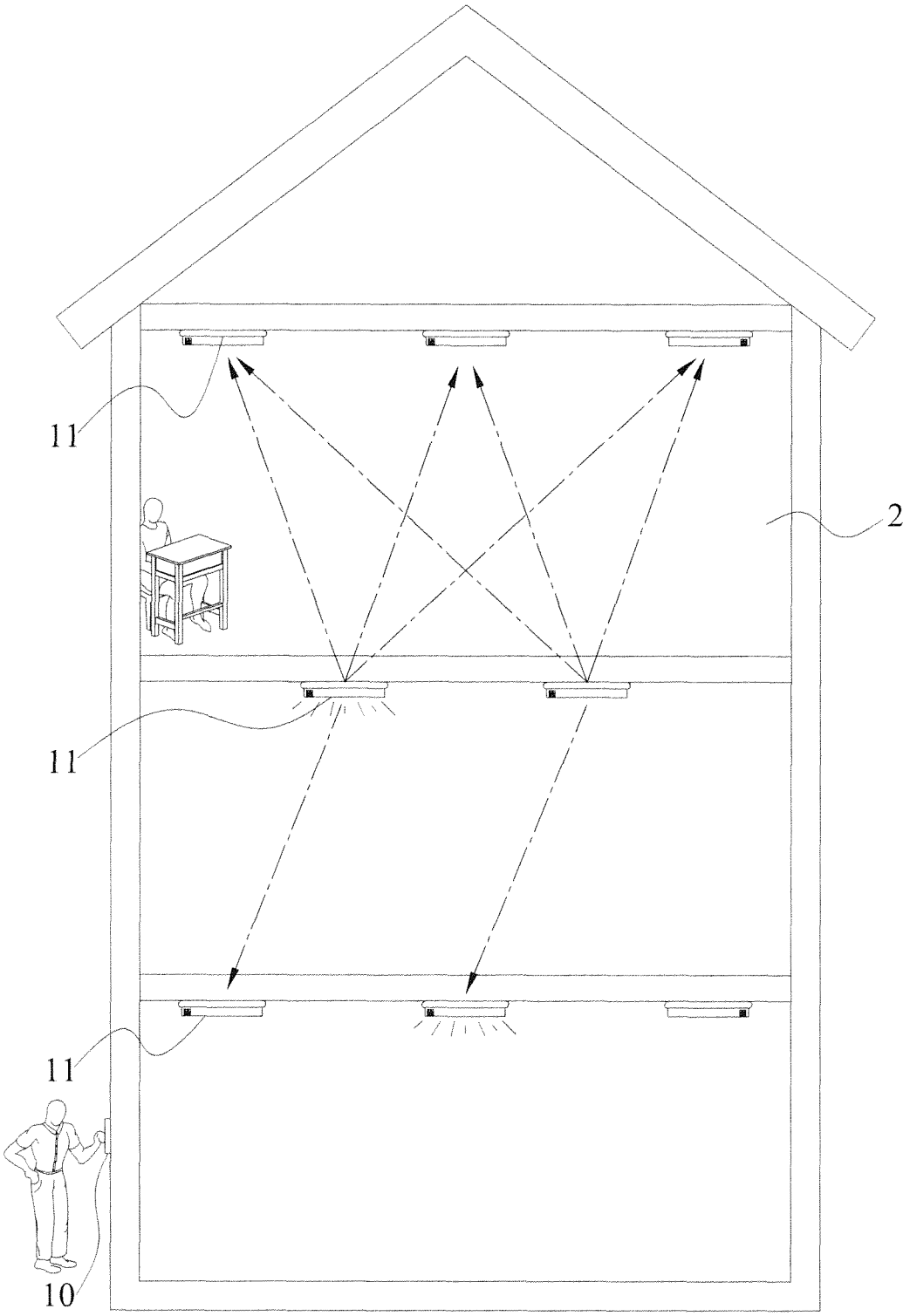
FIG. 5 is a schematic view of a second application of a preferred embodiment of the present invention.
Figure 6:
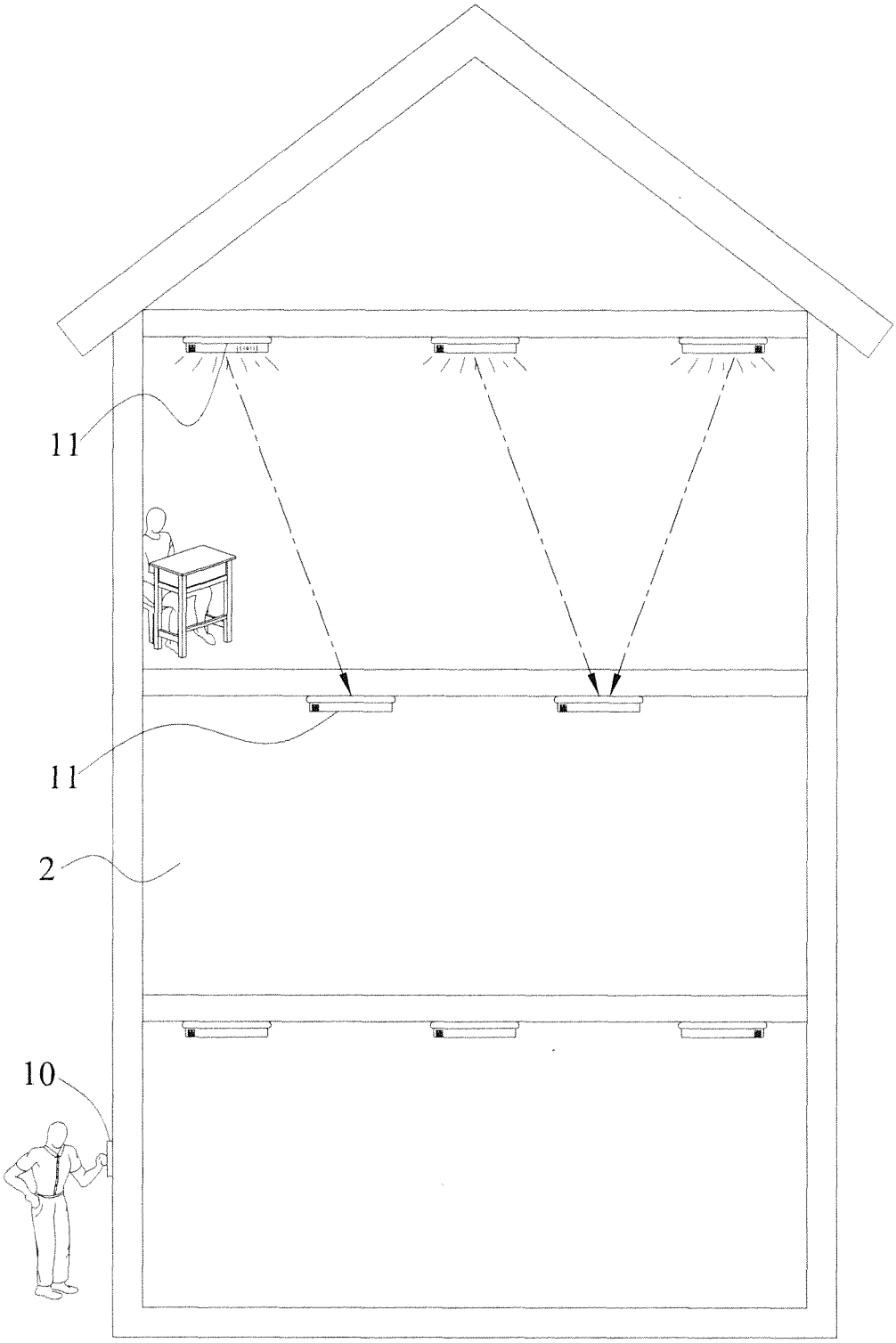
FIG. 6 is a schematic view of a third application of a preferred embodiment of the present invention.

As described above, the lamps 11 firstly receiving the startup signal transmitted from the wireless signal module 101 further send the startup signal out, and then the lamps 11 situated at the second floor receive the startup signal transmitted from the lamps 11 of the first floor while continuing the transmission of the startup signal. If one of the lamps 11 situated at the second floor transmits the startup signal to the lamps 11 at the first floor again, the lamps 11 at the first floor will not transmit the startup signal out again (same as Step 04). This is one of the conditions for the lamps 11 to stop the transmission of the startup signal. After the lamps 11 at the first floor has sent the startup signal out and if no startup signal transmitted from the lamps 11 at other position has been received within the predetermined time, the transmission of the startup signal will be stopped (same as Step S05). This is another condition for the lamps 11 to stop the transmission of the startup signal. Therefore, the present invention transmits the startup signal with the highest efficiency and effectiveness to notify the user as shown in FIG. 5. In FIG. 6, the lamps 11 situated at the second floor transmit the startup signal to the lamps 11 at the third floor, so that the lamps 11 can alarm the occupant of the building, and the lamps 11 at the third floor simultaneously broadcast the startup signal according to the operation information, so as to terminate the signal transmission of the lamps 11 at the second floor.

In summation of the description above, the intelligent wireless doorbell alarm system 1 of the present invention is a device that uses a change of light of the lamps 11 to notify a user or a visitor. If the doorbell switch 10 is not triggered, the lamps 11 may be set by the setup module 121 and used as indoor lighting devices. If the doorbell switch 10 is triggered, the startup signal will be provided for the lamps 11 to give a corresponsive alarm according to the operation information. Regardless of the indoor space of a building with a large area or a multiple of floors, the present invention can drive the lamps 11 quickly and accurately by the wireless communication protocol, and the lamps 11 may serve as a mechanism for broadcasting and sending out the startup signal automatically, so that the lamps 11 may be driven and transmitted without being significantly limited by the distance of the wireless communication protocol. Therefore, a user situated in any area of the indoor space will not neglect the notification about the arrival of a visitor. In addition, the present invention may be operated together with the buzzers 13 to provide a more diversified warning method, and the buzzers 13 may be set up by the electronic device 12 through a wireless transmission.

What is claimed is:

1. An intelligent wireless doorbell alarm system, set and driven by a wireless communication protocol, comprising:

at least one doorbell switch, having a wireless signal module, for generating a startup signal after the doorbell switch is triggered;

a plurality of lamps, each having a wireless transmission module and a driving module, and electrically coupled to one another through each respective wireless transmission module and also electrically coupled to the doorbell switch, and each driving module driving the lamps to give an alarm by light; and an electronic device, electrically coupled to the lamps, and having a setup module for setting the lamps, and operation information being generated and stored after each lamp is set;

wherein, after the lamps receive the startup signal through the wireless transmission modules, the lamps are driven according to the operation information and/or the startup signal is transmitted to the other remaining lamps by the wireless transmission modules; and when each lamp receives the startup signal transmitted from other lamps is received again or the startup signal transmitted from the lamps has not been received within a predetermined time, the lamps stop the transmission of the startup signal.

2. The intelligent wireless doorbell alarm system according to claim 1, wherein the predetermined time falls within a range of 2-5 seconds.

3. The intelligent wireless doorbell alarm system according to claim 2, further comprising a plurality of buzzers electrically coupled to the doorbell switch and the electronic device for accepting the setup and giving an alarm after the startup signal is received.

4. The intelligent wireless doorbell alarm system according to claim 3, wherein the buzzers are installed in the lamps and driven by the driving module.

5. The intelligent wireless doorbell alarm system according to claim 4, wherein each operation information includes setup data of an alarm ON/OFF status, a light display status, a timing function of each lamp, or a combination thereof, and/or a sound reminding status of each buzzer.

6. The intelligent wireless doorbell alarm system according to claim 1, wherein each lamp includes a recognition module having a code corresponsive to each respective lamp for confirming the code of each lamp when the wireless setup module is connected.

7. The intelligent wireless doorbell alarm system according to claim 6, wherein the recognition modules are quick response codes respectively.

8. The intelligent wireless doorbell alarm system according to claim 7, wherein the electronic device is a Smartphone or a tablet PC, and the setup module is an application program.

9. The intelligent wireless doorbell alarm system according to claim 8, wherein each driving module has a storage unit for storing the operation information.

10. The intelligent wireless doorbell alarm system according to claim 9, wherein the wireless communication protocol is one selected from the collection consisting of Bluetooth, WiFi and Zigbee.

11. The intelligent wireless doorbell alarm system according to claim 8, wherein the electronic device synchronously receives the startup signal to display a doorbell ON message when the doorbell switch is triggered.

* * * * *